United States Patent [19]

Witte et al.

[11] 4,047,340

[45] Sept. 13, 1977

[54] SWIMMING POOL MODULAR CONSTRUCTURE

[75] Inventors: Donald H. Witte; Donald H. Weir, both of York, Pa.

[73] Assignee: Fox Pool Corporation, York, Pa.

[21] Appl. No.: 715,528

[22] Filed: Aug. 18, 1976

Related U.S. Application Data

[62] Division of Ser. No. 444,027, Dec. 20, 1974, Pat. No. 3,975,874.

[51] Int. Cl.[2] ..... E04H 3/18

[52] U.S. Cl. ..... 52/169.7; 4/172.19

[58] Field of Search ..... 52/309, 169, 695; 4/172.19

[56] References Cited

U.S. PATENT DOCUMENTS

| | | | |
|---|---|---|---|
| 3,546,720 | 12/1970 | Hoch et al. | 52/169 |
| 3,745,727 | 7/1973 | Chichester | 52/169 |
| 3,789,435 | 2/1974 | Heisner | 52/695 |
| 3,885,364 | 5/1975 | Lankheet | 52/169 |
| 3,906,688 | 9/1975 | Witte | 52/169 |

FOREIGN PATENT DOCUMENTS

| | | | |
|---|---|---|---|
| 2,001,225 | 7/1971 | Germany | 4/172.19 |

*Primary Examiner*—J. Karl Bell

[57] ABSTRACT

A swimming pool having sidewalls constructed from a series of prefabricated modular panels connected at the ends to enclose the interior of the pool. The panels are preferably formed of foamed synthetic resinous composition and of a limited number of configurations or modules which are interchangeably adapted for use in forming pools having a plurality of shapes, e.g. a straight panel, a concave curved panel and a convex curved panel. Each panel is adapted to mate and lock with the adjoining panel, and with an upper and with flanges and rib arrangements which are functional as well as serve to strengthen the panel. In a specific embodiment, a tongue is formed on the flange on one side and a mating groove on the flange on the other side of each panel for instant connecting and interlocking of adjacent panels when they are assembled in forming the pool wall. A sealing strip may be placed within the groove and abuts on the tongue of the adjoining panel thereby precluding leakage between the panels. Support is provided for each panel by at least one brace, preferably molded from synthetic resinous composition, which is positioned to extend normal to or radially from the panel. The brace in a preferred embodiment is formed so that it functions also to interlock adjoining panels by means of clamping means formed at the extremities of the brace. The clamping elements secure and lock two adjacent panels at their juncture. The swimming pool wall modules and brace are arranged to accommodate a pool deck also preferably formed of molded plastic modules. Each deck module may comprise a tongue and groove interlock structure similar to that of the wall panels. The inner periphery of the deck is adapted to be supported on wall panels preferably on an integrally formed flange of the wall panel. The deck is arranged, in a preferred embodiment, to be interlocked into a unitary structure with the wall modules by means of braces which are adapted to clamp the depending flanges or extensions of two adjoining deck modules as well as those of two adjoining wall modules. A coping may be attached to the top edge of the panels and may comprise an extension of the deck surrounding the periphery of the pool. The coping includes means for optionally attaching a plastic pool liner. As an alternative embodiment a wall panel module may be formed with a horizontally extending slot in the inner wall adjacent the bottom edge of the modular side panels for receiving and securing a bead of a plastic liner adapted to cover essentially only the bottom (rather than the sidewall also) of the pool. A bow string clamp, pressed into the slot upon the bead secures the liner in place enhancing water tight integrity. The intermediate rib structure of the panel module is in a preferred embodiment designed to allow nesting therein of the brace when the wall panels are shipped. A modular wall panel may incorporate ladder steps facing the inside of the pool which is adapted also to receive a handrail.

18 Claims, 38 Drawing Figures

20
38
60
16
33
86
32
35
32a
R-1
17
90°
34
39
32a
60
35
86
34
33
39
32
38
36
17
24
36
R-2
60°
28b
79
28
28a
65
76
71
73
72
75

FIG. 25
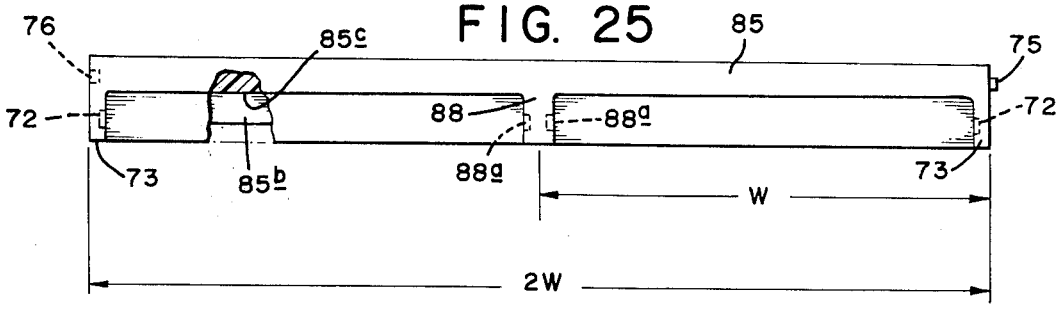
FIG. 26
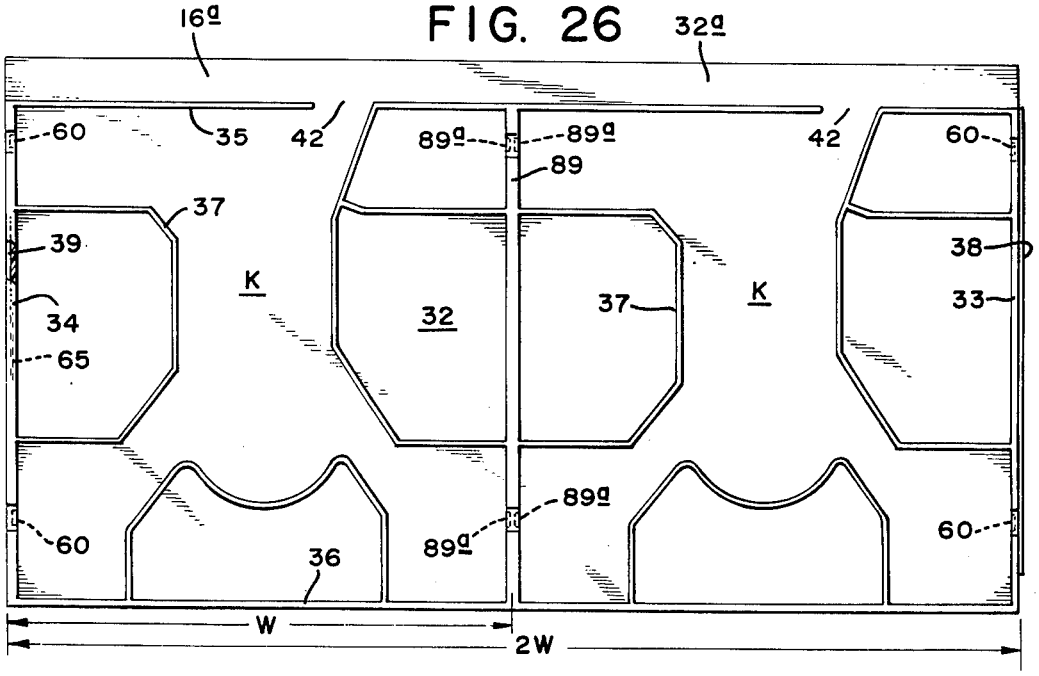
FIG. 27
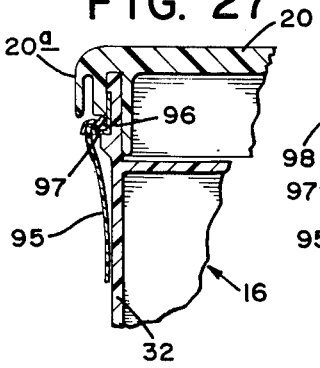
FIG. 27A
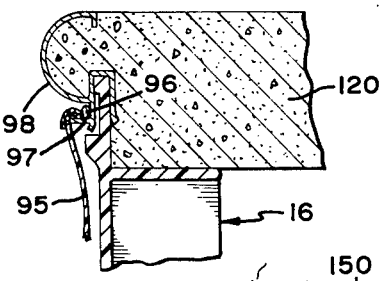
FIG. 32
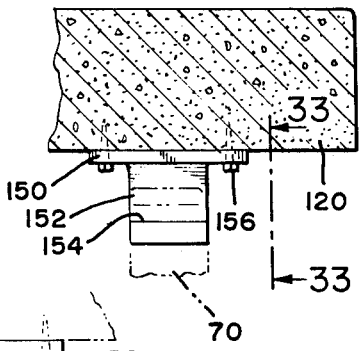
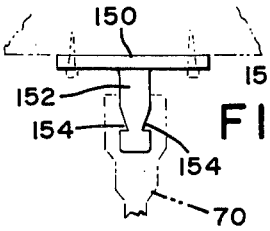
FIG. 33

SWIMMING POOL MODULAR CONSTRUCTION

This is a division of Application Ser. No. 444,027, filed Feb. 20, 1974, now U.S. Pat. No. 3,975,874.

BACKGROUND OF THE INVENTION

This invention relates to improved modular swimming pool construction. While modules formed of various compositions such as wood or metal are not precluded from the contemplation of the present invention, the invention preferably embodies modules of synthetic resinous compositions and most advantageously foamed compositions. The modules which comprise essentially the wall panels and braces and optionally additional elements such as deck panels, coping and the like are designed for use in various shapes and contours of pools such as rectangular, round, oval, and "kidney" shaped, and various free-form contoured pools.

Ordinarily, in constructing pools in accordance with the prior art, the cost increases significantly when a customer selects a pool which is other than rectangular in shape. In order to provide a pool having a special shape, it has been necessary generally to design specially the entire structure which was tailored to the desired shape—this results in higher costs and requires a greater consumption of time which is an even more costly factor. Furthermore, with pools of shapes other than rectangular, the difficulties of erecting it are compounded by the fact that labor of relatively greater skill is needed for the installation, and such labor is in short supply, particularly when called upon sporadically as frequently occurs in the swimming pool construction field.

SUMMARY OF THE INVENTION

The present invention is directed to an improved prefabricated design of sidewall panels, braces, deck modules and the like which are essentially standard and which lend themselves to use in a variety of different shaped pools. The salient features of the modular components of the invention are adaptable to standardization and may be contoured which permits the use of individual components interchangeable in the construction of a variety of swimming pool shapes. Moreover, the invention contemplates prefabricated modular components of simplified design which require a minimal expertise at assembly.

An important feature of the invention is to provide modular wall (and optionally deck) modules comprising "male" and "female" interlocking elements at opposite sides of the module for connecting and locking with adjoining or contiguous panels when the modules are assembled in situ, preferably using braces which are adaptable to said modules and therewith form a substantially integral structure.

An important advantage of the invention is to simplify assembly procedures by use of novel supporting braces which incorporate combined locking and fastening means at the abutting joints of both the wall panels and, optionally, of the deck modules.

A further advantage of the invention is to provide a system using a relatively limited number of interchangeable shapes which, when assembled in situ, may be used to construct a variety of pool contours. An additional advantage resides in providing said panels of flexible composition to facilitate bending thereof in situ to permit the construction of an unlimited number of desired free-form shapes.

A further advantage of the invention resides in the provision of straight and curved deck modules for matching the wall panel modules in constructing a desired pool shape.

Further objects reside in the provision of pool wall modules with integrally formed utility line openings or knockout segments.

Another advantageous feature of the invention resides in the provision of a modular panel with integrally formed reinforcing ribs and/or contour protuberances.

A further advantage of the invention resides in the provision of pool wall modules with a novel sealing element formed in the mating configuration of contiguous assembled modules.

An additional advantage resides in the novel securing and sealing means within the pool wall module of a pool liner adapted to be used to cover substantially the lower wall portion and bottom of the pool.

Another important advantage of the invention resides in the provision of a novel brace member with optional integrally formed clamping and supporting capabilities for the pool wall and/or deck assemblies.

Various additional objects and advantages will become apparent from the following description taken in conjunction with the accompanying drawings.

BRIEF DESCRIPTION OF THE DRAWINGS

FIG. 25 is a side elevational view of a typical straight deck module.

FIG. 26 is an elevational view of a long, e.g. double, wall panel module.

FIG. 27 is a fragmentary sectional view of the coping structure showing the liner attached within a slot formed integrally in the coping.

FIG. 27A is a view similar to FIG. 27 showing alternate coping and cast concrete deck.

FIG. 32 is a fragmentary sectional view of one side of a conventional cast concrete deck with means for supporting same.

FIG. 33 is a sectional view taken along line 33—33 of FIG. 32.

DESCRIPTION OF THE PREFERRED EMBODIMENT

The structural pool arrangement of the invention is preferably utilized in conjunction with below-ground outdoor swimming pool constructions. However, the invention should not be construed as being limited to this type, as it will be apparent to the skilled craftsman that many variations and modifications are possible not only in below-ground construction but also in above-ground installations and a combination of both and, in some cases, with appropriate modifications, in erecting permanent or temporary indoor installations.

Figures 1, 2, 3:
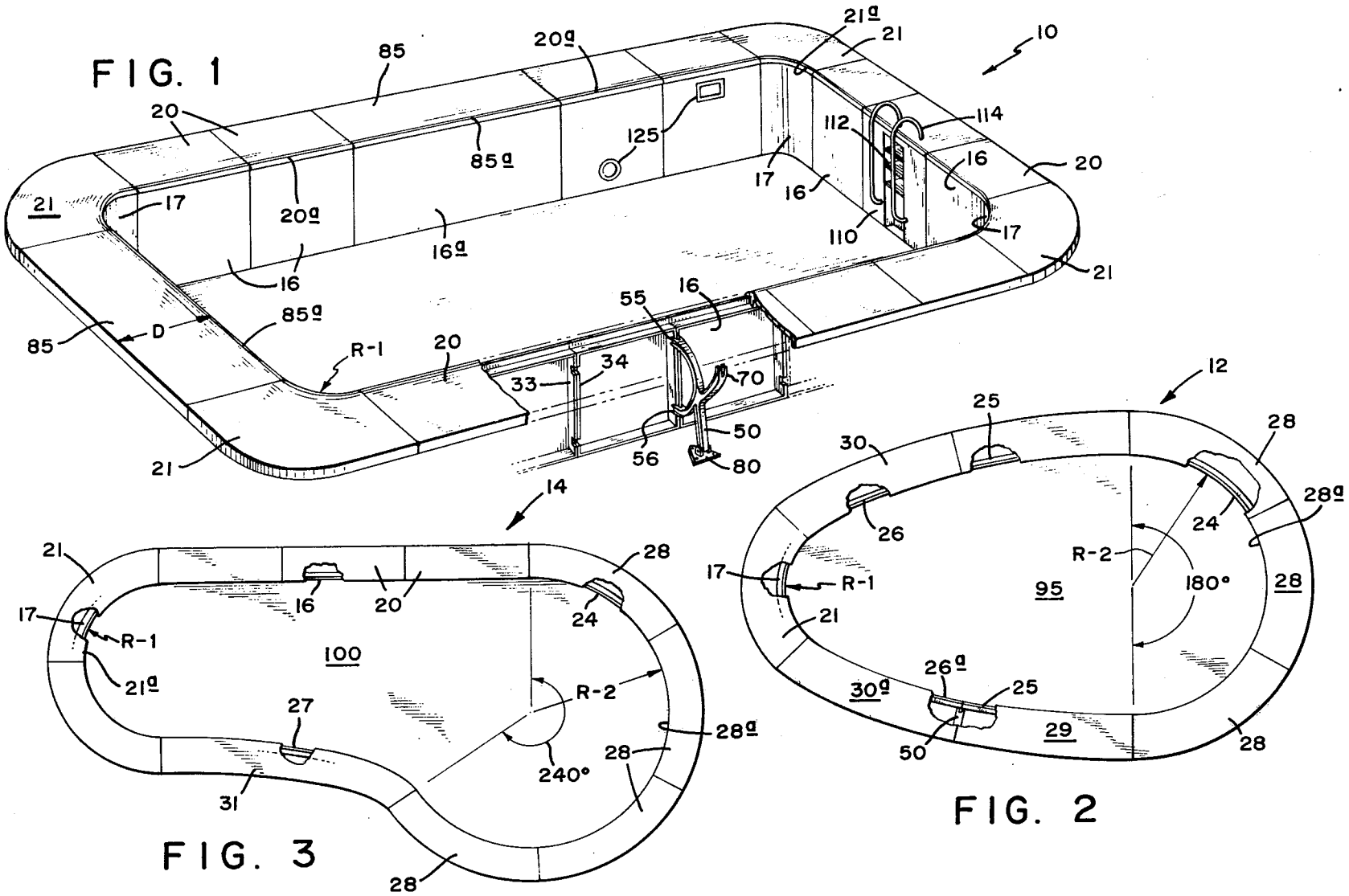
FIG. 1 is a perspective view of a rectangular swimming pool with portions broken away to illustrate some of the structural features.
FIG. 2 is a plan view illustrative of an oval shaped pool of the kind which, may be constructed from the modular elements of the invention.
FIG. 3 is a plan view of a kidney-shaped pool illustrative of another shape which may be formed using elements of the invention.

One important feature is that the invention readily lends itself to a wide variety of swimming pool contours such as the rectangular pool 10, illustrated in FIG. 1. The oval pool 12 shown in FIG. 2 and a kidney-shaped pool 14 delineated in FIG. 3. These shapes are merely illustrative of the many possiblities and are not meant to be restrictive. In fact, the invention is advantageous in that it permits construction of a wide variety of free form pool shapes to suit individual preferences.

Each of the main components of the swimming pool is designed so as to be advantageously formed from molded synthetic resinous composition, preferably of foamed molded plastic composition.

Referring to the drawing, rectangular pool 10 of FIG. 1 is constructed with a sidewall composed of a plurality of relatively flat panel modules 16 which delineate the side and end walls and curved or corner wall modules 17. A moderate radius at the corners is not meant to be restrictive but is preferable to square or sharp corners in that there is a lesser tendency to collect debris in this area. A coping is preferably formed as an integral portion of the deck modules providing a smooth transition from the wall to the deck surface, although it will be apparent that a separate coping may be used. The modular structure of FIG. 1, it is seen, comprises straight deck modules 20 along the sides and ends of the pool in combination with interconnecting curved deck modules 21.

The modular design of the side wall and deck components permits the adaptability of the invention to standardization including interchangeable parts which will allow a variety of pool shapes with a minimum of different modular components. For example, the curved corner panel 17 may be adapted for use not only at the small end of the oval shaped pool 12 but also at the small end of the kidney-shaped pool 14. Also, the large concave curved panels 24 used in the oval pool 12 can be used in the large end of the kidney pool 14 and the straight panels 16 of the rectangular pool 10 can be used on the straight side of the kidney pool and, in case of a large oval pool, for some of the center panels of the longer dimension. The only special panel required in the construction of kidney-shaped pool 14, for example, might be a convex shaped panel such as that shown at 27 since other panels may be designed for use in at least two of the three shapes shown. Moreover, it will be apparent that any special shaped panels such as the convex kind may be designed so that they are adaptable in other free form pool contours, not shown.

The wall panel modules are designed to be advantageously molded or prefabricated from a plastic such as a polyolefin which is readily molded into the desired structural shapes preferably as a relatively dense foam composition. However, the preferred embodiment comprisng plastic material is not intended to preclude the utilization of the modular panels of the invention from other materials such as metal, pressed board, or other compositions. Additionally, the several modules may be formed of the same or different plastic material, or one or more component of the combination of modules which comprise the pool may be formed of a material other than plastic, e.g. metal, wood, particle board, pre-cast concrete, and the like, for example.

Deck modules may be similarly prefabricated to provide the interchangeable feature such as the use of the curved deck module 21 in all three pool contours as shown in FIGS. 1 through 3. The straight deck modules 20 are adapted for use in pools 10 and 14, although they may be used in some oval pools also in sections where the curvature is less severe. The large curved deck modules 28 can be used in both the oval pool 12 and the kidney pool 14. Additional deck module shapes of suitable radii are the concave modules 29, 30 and 30*a* shown in the oval pool 12 and the convex curved module 31 shown in the kidney pool 14.

It will be readily understood that with the employment of standardization with interchangeability, the costs of varied contours of swimming pools will be substantially reduced since the variety of specially fabricated individual components will be minimal.

Figure 4:
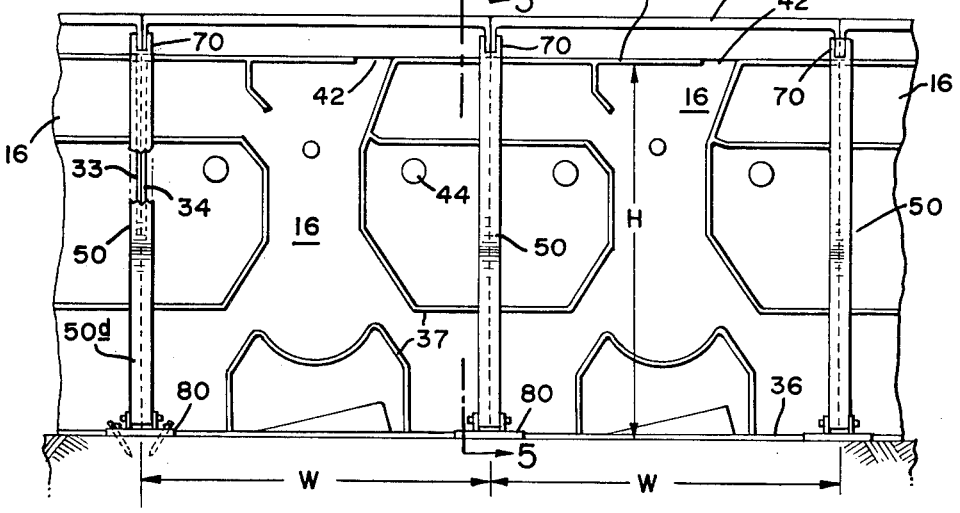
FIG. 4 is an elevational view of a portion of a pool wall taken outside the pool illustrating two full wall modules and additionally fragmentary portions of two contiguous modules.
Figure 5:
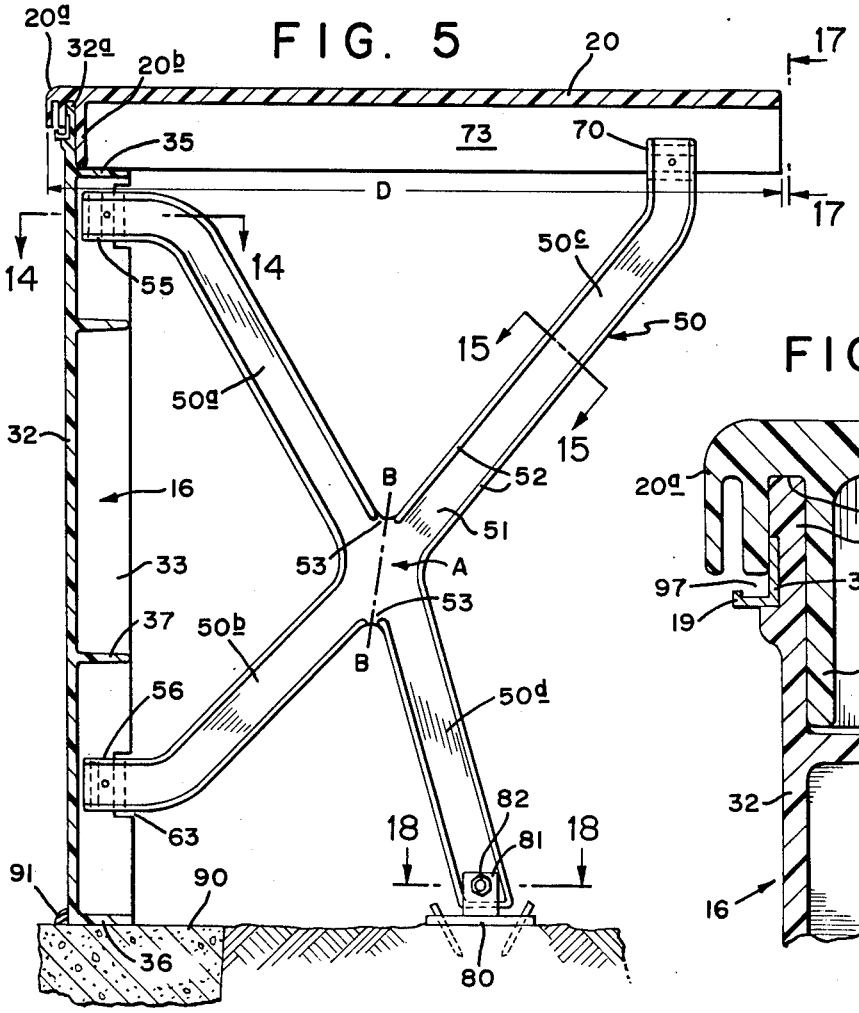
FIG. 5 is a sectional view taken along line 5—5 of FIG. 4 illustrating in position the pool wall, deck, coping and supporting brace of preferred configuration.
Figure 15:
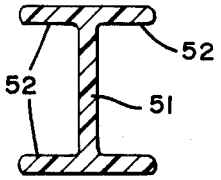
FIG. 15 is a sectional view taken along line 15—15 of FIG. 5.
Figure 16:
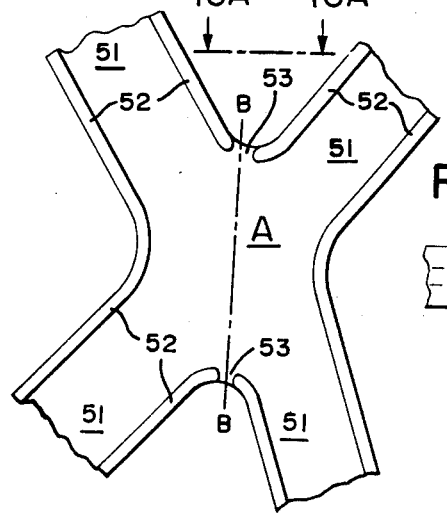
FIG. 16 is an enlarged view of the area A of FIG. 5.
Figure 16A:
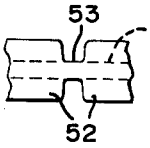
FIG. 16A is a view taken along line 16A—16A of FIG. 16.

The modules forming the pool walls are supported in assembled position by suitable braces 50 attached to the wall panel modules and extending in a vertical plane substantially perpendicular to or radially from the outside face of the wall modules as shown in FIGS. 4 and 5. These braces also are preferably molded from plastic material although the use of other suitable compositions may be used. The brace 50 may be conveniently formed so as to have a substantially X-shaped configuration which conveniently lends itself for use with the wall and deck components; however, it should be understood that the brace may comprise any adaptable shape. As shown, the brace 50 is constructed with arms 50*a*, 50*b*, 50*c* and 50*d* preferably having an I-beam cross section for strength and a rigidity as shown in FIG. 15. A webb 51 having flanges 52 which extend along the edges of the central area A, FIG. 16, and merge with comparable flanges of an adjacent arm. There is an interruption in the flanges at points 53 in the central area A, on both sides of the webb, as seen in FIG. 16A, to permit some flexing or bending of the brace substantially along a line B—B for convenience in manipulating and positioning the brace.

Figure 6:
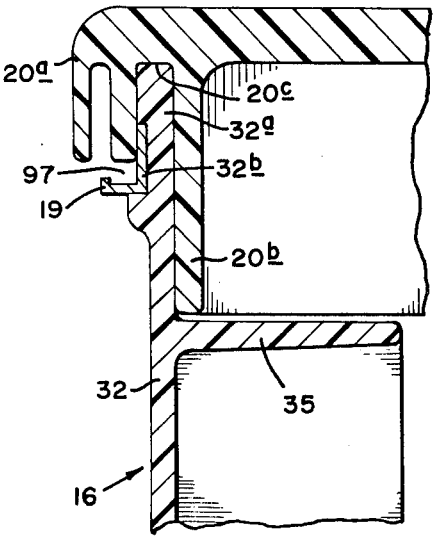
FIG. 6 is an enlarged view showing the coping illustrated in FIG. 5.
Figure 8:
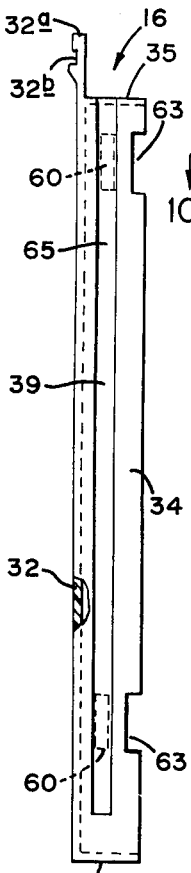
FIG. 8 is an end view of the panel of FIG. 7 taken along line 8—8 of FIG. 7.

Referring to FIGS. 7 through 10, a typical straight wall panel module 16 comprises a wall section 32 having outwardly extending end flanges 33 and 34, a top flange 35, a bottom flange 36 and intermediate ribs 37, all of which are formed integral with the wall section 32 for imparting rigidity and strength to the panel. A male-female type interlock feature is provided at the ends of the wall modules in the form of a tongue 38 which is formed on one end in flange 33, and a groove 39 formed at the opposite end in flange 34. Upon assembly of the panels 16 in situ in an end to end abutting relationship, the tongue of one panel is inserted into the groove 39 of the adjacent panel thus locking against relative horizontal movement between the panels. The resulting structure becomes a substantially integral wall having greatly improved strength and rigidity. A top flange 35 is preferably located a spaced distance from the top edge of the wall section 32 and allows mounting of the deck module 20 as best shown in FIGS. 5 and 6.

Figure 7:
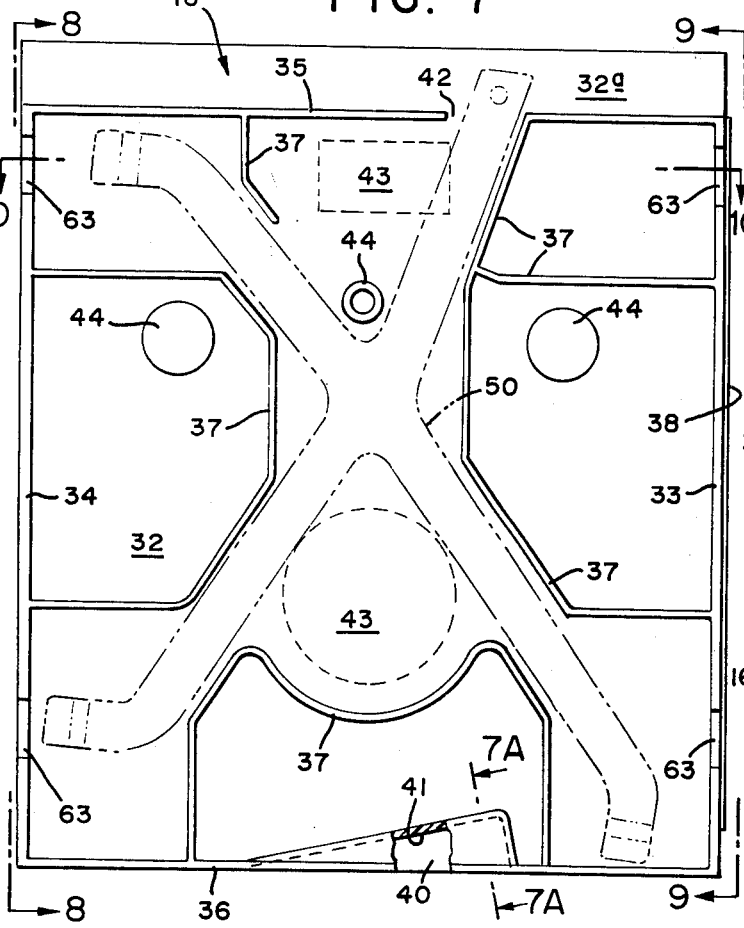
FIG. 7 is an elevational view of a single wall panel module illustrating in phantom a brace nested in the wall panel module as when packed for shipping.
Figure 9:
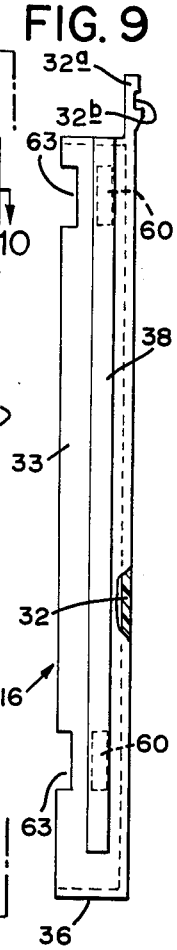
FIG. 9 is an opposite end view of the panel taken along line 9—9 of FIG. 7.
Figure 10:
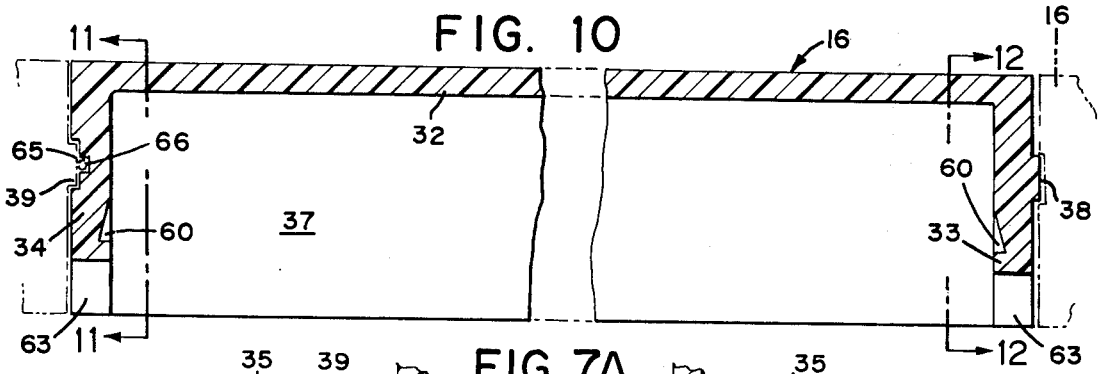
FIG. 10 is an enlarged sectional view taken along line 10—10 of FIG. 7 illustrating the mating and seal features of contiguous panels.
Figure 7A:
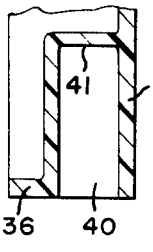
FIG. 7A is a sectional view taken along line 7-7A of FIG. 7 showing an integrally formed panel height adjusting mechanism.

Shown integrally formed at the bottom of the pool wall module 16 is a device for leveling the wall panels. The leveling means comprises a slotted opening 40 in the bottom flange 36 having a tapered surface 41 for wedging action in leveling the panel (FIG. 7A). Displacing of the wedge towards the lower portion of the inclined surface 41 elevates the panel 16. The wall modules are suitably designed so as to accommodate the brace in a nested position as by forming an opening 42 in the top flange 35 together with a special arrangement of the ribs 37, as best shown in FIG. 7. The nesting feature is an important advantage for shipping and convenience in assembling the structure in situ. The wall section modules may also be provided with various access means or openings. For example, knock-out areas 43 having reduced wall thickness or bosses 44 which may be used for attaching various accessories such as a skimmer, lights, etc., through the pool wall.

Figure 11:
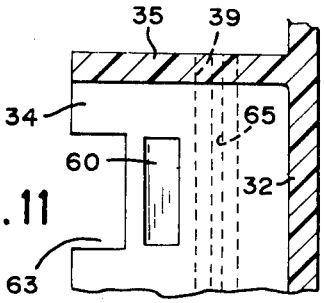
FIG. 11 is a fragmentary sectional view taken along line 11—11 of FIG. 10.
Figure 12:
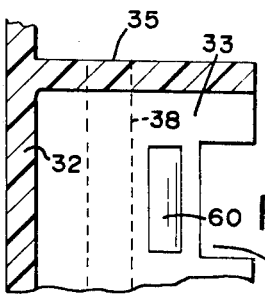
FIG. 12 is a fragmentary sectional view taken along line 12—12 of FIG. 10.
Figure 13:
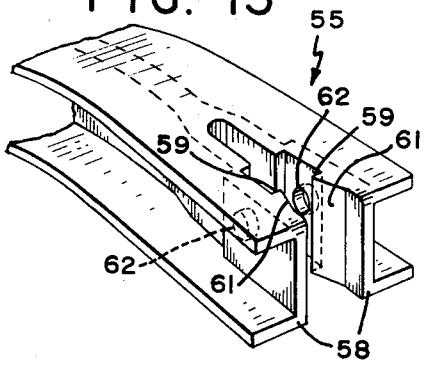
FIG. 13 is a perspective view of a typical integrally formed clamping device used to secure adjoining modules.
Figure 14:
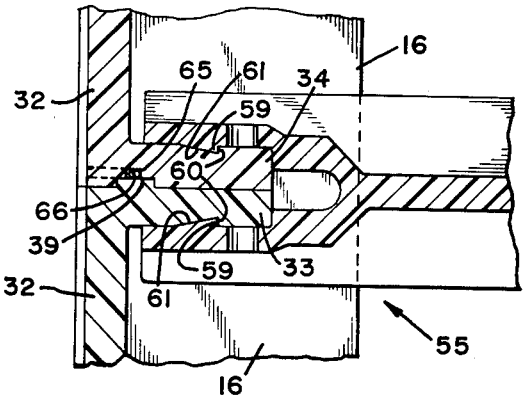
FIG. 14 is a sectional view taken along line 14—14 of FIG. 5 illustrating the clamping mechanisms at the point of securing the modules.

As the adjacent wall panel modules 16 are assembled by mating the tongue and groove device described above, they are further secured against relative vertical movement between the panels. This is accomplished by attaching suitable clamping mechanism, e.g. clevis 55, to the assembled end flanges 33 and 34 of adjoining panels at an elevated point on the vertical panel adjacent the upper flange 35. A second clamping arrangement, e.g. clevis 56, is attached so as to secure two adjoining panels adjacent the lower flange 36. The clamping means may be formed on the ends and be an integral part of the brace member as shown in FIG. 5. While any suitable clamping arrangement may be used, a preferred device is a clevis type structure of the kind shown in enlarged detail in the illustration of FIG. 13. The configuration of FIG. 13 is designed to grip two adjoining members. The arrangement shown in FIG. 13 permits the jaws 61 to be opened against a spring-like or elastic force and securely hold the adjoining modular members together. The arrangement of the clevis device shown in FIG. 13 comprises bifurcated ends 58 which are adapted to straddle the flanges 33 and 34 of adjoining modules 16. Protuberances or extension portions 59 formed within ends 58, due to the inherent resilience of the material of construction, are adapted to snap into two horizontally opposed slots 60 formed in the flanges as best shown in FIG. 14. The flanges 33 and 34 are undercut as at 63, FIGS. 11 and 12, to accommodate the throat of the clevis 55. The inherent strength of the material is sufficient to hold the flanges in locked position, however, holes 62 (FIG. 13) are provided in the clevis 55 to receive therein a pin or bolt, if desired, for further securing the panels in assembled position. Inclined surfaces 61 adjacent the hooked portion 59 serve to spread the bifurcated ends 58 upon being pressed over the flanges 33 and 34.

As the modules are assembled, an inner channel 65 within the groove 39 in flange 34 is adapted to receive a compressible "O"-shaped sealing strip 66 of any suitable material such as rubber. The seal prevents leakage and obviates the need for a conventional liner. Also, when only a bottom liner is used, as will be described hereafter, the seal 66 is employed to provide water tight integrity of the wall.

Figure 17:
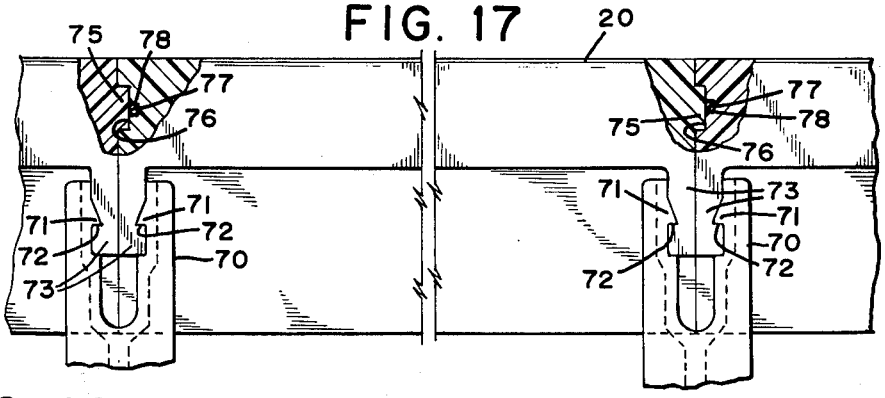
FIG. 17 is a sectional view taken along line 17—17 of FIG. 5 illustrating the clamping of contiguous deck modules.

Referring again to the brace member 50 (FIG. 5), it is seen that an additional arm 50*c* is provided. Arm 50*c* is advantageously formed so as to accommodate a support for the horizontal deck 20. However, this deck support feature is optional and when no deck is involved or when other means for supporting the deck is employed, the arm 50*c* may be omitted from the form of brace 50. The arm 50*c* is formed so as to terminate similarly as 50*a* and 50*b* in a clevis 70 (which, however, faces upward and) which furnishes interlocking support for the deck modules 20 that are arranged to mate similarly to the wall panel modules described above. With reference to FIGS. 5 and 17, it is seen that the arrangement of the clevis 70 is similar to the clevis 55 and includes to horizontally facing hooked portions 71 adapted to snap into two horizontally opposed slots 72 formed in the abutting flanges 73 of the deck module 20. The end flanges 73 of the deck module depend from and are formed integral with the deck 20. A tongue and groove interlock 75 and 76 respectively serves to further secure the deck in proper position and, if desired, can be provided with a sealing member 77 inserted in an inner groove 78 in a manner similar to the wall panels 16.

Referring to FIGS. 5 and 6, it is seen that the deck 20, which is supported at one side by the brace clevis 70, is supported at the other side on the wall panel 16. The deck module 20 is provided on the inner side with an overhanging tongue or edge arrangement 20*a* having a suitable radius to form a coping. The coping 20*a* is formed so as to be spaced from the support for the deck providing more cushion in the coping. A depending stiffening rib or reinforcement flange 20*b* extends longitudinally beneath the deck in spaced relation to the coping and a slot 20*c* adjacent the rib 20*b* is adapted to receive the vertical extension or top edge 32*a* of the wall 32 of the wall module 16 for supporting the deck. The wall extension 32*a* may be suitably adapted such as with undercut 32*b* to receive a liner attachment and support member 19 which partially extends into the slot 20*c* (FIG. 6) formed in the deck module and secured in place by the wall of the slot.

Figure 5A:
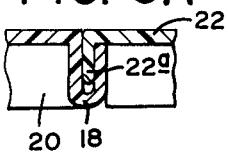
FIG. 5A is a fragmentary sectional view of one side of a deck showing a means for attaching deck modules.

In some instances, it may be desirable to provide a wider deck for a pool. One manner in which this can be accomplished is to attach an additional deck module along side the deck 20 as illustrated in FIG. 5A. For this purpose, the outer edge of the deck 20 is provided with a U-shaped flange 18 which is adapted to receive a depending flange 22*a* of another deck module 22 for interlocking the deck modules 20 and 22 together. Suitable means such as the ground or other arrangement supports these decks which may extend radially several tiers from the inner periphery of the pool.

Figure 18:
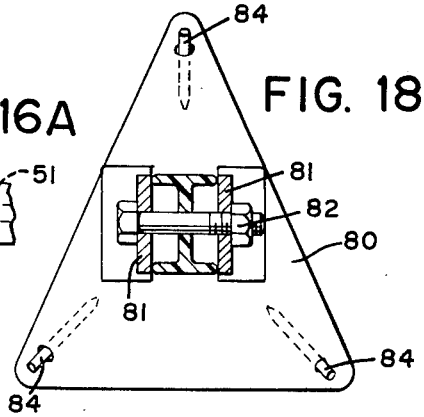
FIG. 18 is a sectional view taken along line 18—18 of FIG. 5 illustrating one form of brace footing arrangement.

It is apparent from the foregoing that the brace serves to integrate the wall panels and deck modules into a sturdy unitary structure. The brace itself is appropriately secured such as by attachment of the arm 50*d* of the brace 50 to an anchor plate 80 which is suitably fastened to the ground. As shown spaced flanges 81 on the anchor plate are adapted to receive the lower end of the brace arm 50*d* which is fastened by a bolt 82 as best shown in FIGS. 5 and 18. Stakes 84 or other appropriate means such as bolts embedded in concrete footings (not shown) secure the anchor plate 80 against movement relative to the ground. It will be understood that various other alternate means of anchoring the brace may also be used.

Figures 19, 20, 21, 22, 23, 24:
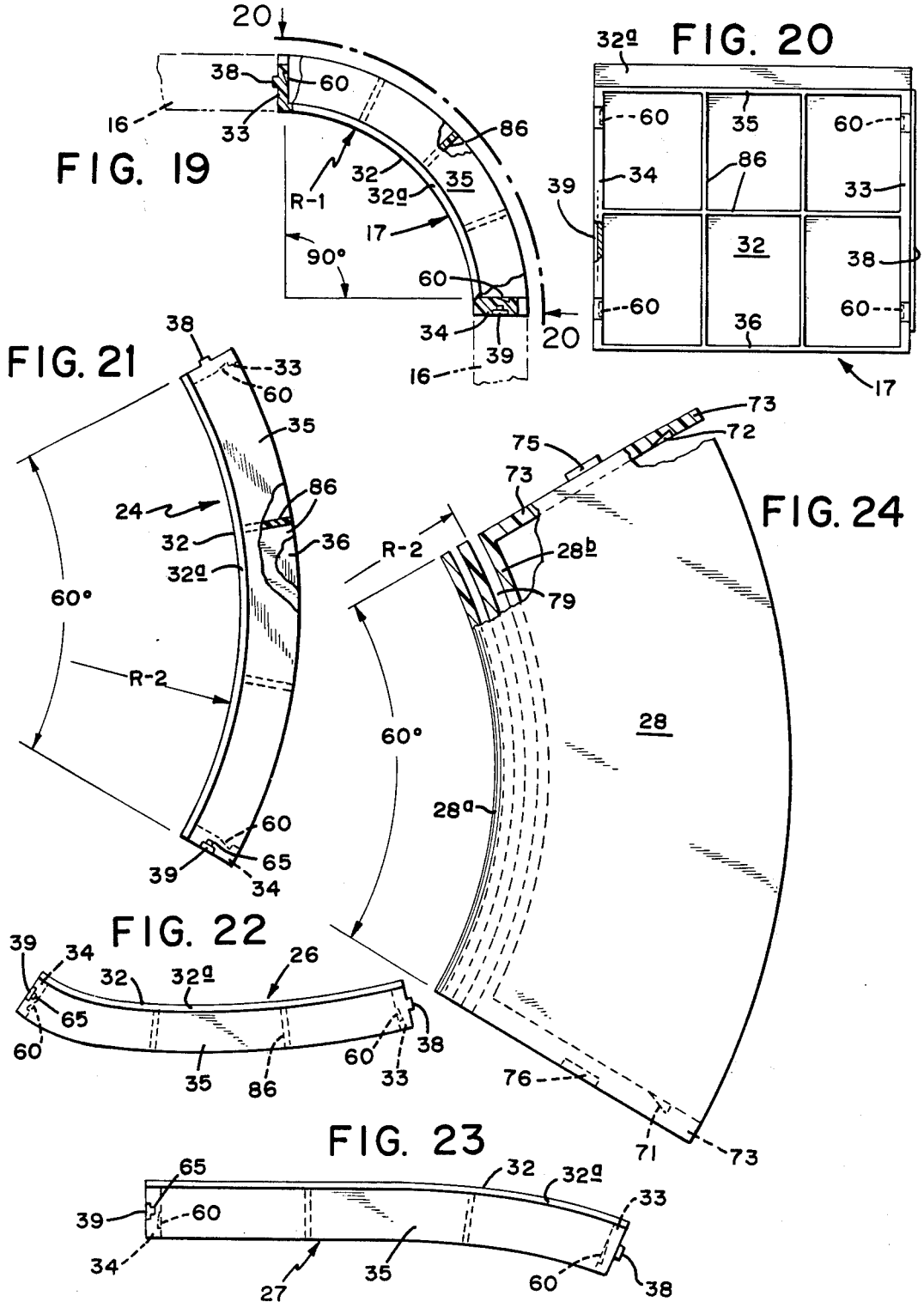
FIG. 19 is a plan view, partly broken away of a typical corner wall panel or module.
FIG. 20 is an elevational view taken along line 20—20 of FIG. 19.
FIG. 21 is a plan view of a typical large concave curved wall module having a curve defined by a radius.
FIG. 22 is a plan view of a typical non-radial concave curved wall panel or module.
FIG. 23 is a plan view of a typical non radial convex curved wall module.
FIG. 24 is a plan view of a typical concave curved deck module.

The round corner panel module 17, illustrated in FIGS. 19 and 20 is designed to have suitable interlocking features such as those described in connection with panel 16 for interconnecting therewith. In this respect, similar features will be identified by the same reference numerals. It is thus seen that end flanges 33 and 34 on the panel 17 have a tongue and groove 38 and 39 respectively for mating with adjacent panels. Slots 60 are molded into the flanges to accommodate the clamping means or clevis in a manner similar to that described in reference to the panels 16. As stiffening and strengthening means for the panel 17 a simple rib structure which may comprise vertical and horizontal ribs 86 shown in FIG. 20 may be used. The corner panels 17 are arcuate in form, extending substantially 90° and having a radius R-1 to form the corners for the rectangular pool 10. It will be noted that one or more of the panels 17 can be used in constructing pools of different contours such as the oval pool 12 and kidney pool 14. Moreover, it will become apparent that various contours, degrees of curvature and shapes of panels may be fabricated to suit the desired line of pool configurations. Preferably, the structural composition is a foam plastic material described in greater detail below. However, any suitable structural composition may be used, as the intention is not to limit the advantages of the structural novelty of the invention to plastic compositions.

A wall module 24 having a smaller degree of curvature is illustrated in FIG. 21, e.g. having a radius R-2 of about 60° which is arbitrarily chosen for purposes of illustration and not limitation. The panel 24 is designed similarly to the panel 17, described by reference to FIG. 19, having tongue and groove connections 38 and 39 respectively formed in flanges 33 and 34 at the ends of the wall 32, top and bottom flanges 35 and 36, respectively, and ribs 86 which lend strength to the wall. A projecting top edge 32*a* of the wall 32 is used for attaching a suitable deck module 28 which will be described below, and a slot 65 in the groove 39 receives a sealing strip (not shown). Referring to FIGS. 2 and 3, the interchangeability of the modules is illustrated. In the oval pool of FIG. 2 it is noted, the large end of the pool 12 describes a 180° curve into which three panels 24 are adapted to fit, while four of the panels 24 may be used to construct a 240° segment at end of the kidney pool 14 of FIG. 3. In order to complete the walls of the oval pool 12 in addition to the panels 17 and 24 described above, three different wall panels 25, 26 and 26*a,* are employed although it is possible to use only two or a number larger than three different modules. It is understood that all of the modules are constructed with a suitable mating means such as the above-mentioned interlocking and interconnecting features which are illustrated by the same reference numerals. Accordingly, it is seen that the main difference between the various wall panels is the horizontal contour as will be observed with reference to the above-mentioned three panels 25, 26 and 26*a,* only one of which is shown in enlarged plan view (FIG. 22) to illustrate the panel 26. This panel is constructed with a non-arcuate concave curve adapted to suit the oval pool 12 and having all the standard features mentioned above. The panel 26*a* is similar to 26 except that it is a mirror image of 26 adapted to suitable attach to the opposite side of the panel 17. The panel 25, also having a concave curved contour is adapted for use on opposite sides of the pool, FIG. 2.

Similarly, in addition to the curved panels 17 and 24 and straight panels 16, a special convex curved panel 27 is adapted to complete the shape of the kidney pool of FIG. 3. An enlarged plan view of the panel 27 is illustrated in FIG. 23 and incorporates the interconnecting features described above.

The deck modules are prefabricated to conform to the contours of the sidewall panels as will become apparent by reference to FIGS. 1 through 3. The curved deck modules are adapted to interlock with the straight deck modules or with other curved deck modules to surround the pool. It is understood, however, that if desired the deck need not surround the pool but can attach at any segmental portion thereof. A plan view of a curved deck module 28 is shown in FIG. 24 and is representative of a typical curved deck module structure incorporating the interlocking features described above for the straight deck module 20 illustrated in FIG. 17. The arcuate module 28 extends angularly 60° to coincide with the wall panel 24 to which it is attached. The inner edge 28*a* of the deck 28 is formed with a suitable radius to match that of adjoining modules such as the deck 20, FIG. 6, to form a continuous coping structure. A depending rib 28*b* is formed with an arcuate slot 79 having a radius R-2 to receive the top edge 32*a* of the panel 24 which is constructed with a similar R-2 radius for mounting in a manner similar to that described in conjunction with the deck 20, FIG. 6. The deck 28 is formed with end flanges 73 having slots 72 for connecting the clevis and tongue and groove interlocking means 75 and 76, respectively.

Inasmush as the deck modules and wall panel modules attach at their terminal ends to a common X-brace, they are normally formed so that they will be the same length, W, FIG. 4. It may be purposeful, however, to fabricate deck modules of greater lengths which, apparently, will be multiples of the basic modular length W, such as a 2W length deck module 85 illustrated in FIG. 25. The longer module can replace two modules 20 as seen in FIG. 1, wherein a coping portion 85*a* is designed to match the coping 20*a* of the adjacent deck module 20 to provide a continuous coping structure. A depending longitudinal rib 85*b* contains a slotted portion 85*c* to receive the top edge 32*a* of the wall panel for mounting similar to the deck 20 FIGS. 5 and 6. The deck 85 also includes standard end flanges 73 which are provided with slotted openings 72 for attaching the clamping means, i.e. the clevis 70 and a tongue and groove locking means 75 and 76, respectively, similar to the deck 20. Additionally, the double module is formed with an intermediate rib 88 having a thickness of two end flanges 73 to properly receive the clevis 70 which is adapted to snap into slots 88*a* when an intermediate clevis support is desired. It will be apparent that the 2W length deck 85 can mount upon a wall panel 16*a* of similar length, described below, or can attach to two W length panels 16. Obviously, longer deck modules can be utilized, if desired, such as a 3W length, etc, although practical consideration of shipping and difficulty in handling preclude the desirability of excessively large modules.

It may be opportune, furthermore, to fabricate wall panel modules of greater lengths which can be inserted in the larger pools such as the panel 16*a* in FIG. 1. The panel 16*a* occupies the space of two smaller panels 16 or, in other words, has a 2W length as illustrated in FIG. 26. It will become apparent that inasmuch as the panel modules are the basic building blocks, their lengths are not dependent upon dimensions of other components, but only upon the over-all pool dimensions. Therefore, with reference to the W dimension, the panel can be 1½W or 3W or any other convenient increment to suit the total dimensions of the pool. Inasmuch as one brace is adapted to secure two interconnecting ends of adjacent panels, it will be apparent that the number of braces required will be the same as the number of panels, or one brace per panel. Consequently, the longer 2W panel 16*a* will require two support braces. For this purpose, an intermediate rib 89 is formed integral with the panel wall 32 and having horizontally opposed slots 89*a* and the proper thickness for attaching an upper clevis 59 and a lower clevis 55 as described for the panel module 16. A rib structure 37 for strengthening the wall 32 is formed integral therewith and designed to describe an area K on either side of the rib 89 for nesting supporting braces 50 in a manner similar to that described by reference to FIG. 7. Other details of the panel 16*a* are similar to the panel 16 viz. end flanges 33 and 34 including a tongue and groove 38 and 39 respectively, and slots 60 to receive the clevises 55 and 56; a bottom flange 36 and top flange 35 spaced from the top edge 32 for mounting the deck and an inner groove 65 in the flange 34 for receiving the sealing strip 66.

The sealing strip 66 is employed as a convenient and effective mechanism to prevent leakage at the juncture of the panels and provide water tight integrity. Other sealing means of the kind known to those skilled in the art may also be used. To seal the juncture of the panels and floor of the pool any suitable means can be employed such as a caulking strip 91, FIG. 5. This, of course, presupposes that the pool floor has been suitably prepared such as a poured concrete floor 90. Alternatively, all of the above mentioned sealing means can be omitted and a suitable plastic liner 95 may be attached in the support member 19 by the peripheral bead 96 of the liner 95 (FIGS. 6 and 27) to cover the walls and floor of the pool.

It will be noted that the molded deck modules need not necessarily be used with the molded wall panel modules which are readily adapted for use with any type of structure such as a cast concrete deck 120 illustrated in FIG. 27A wherein a conventional coping 98 is positioned at the top of the wall and the concrete deck is poured in situ filling the cavity of the coping 98, securing it in place. Alternatively, a concrete module preformed in combination with coping 98 may be used. The liner bead 96 is secured in a conventional manner in the retaining recess 97 to support the liner 95. The opposite side of the cast deck 120 is supported in any convenient manner which may include brace 50. When the brace 50 is utilized in supporting a concrete or other deck an adaptor plate 150 which is constructed with a depending portion 152 may conveniently be employed. The adaptor 150 is provided with slots 154 arranged to receive a clamp, i.e. the clevis 70 of the brace 50, as shown in FIGS. 32 and 33. The adaptor plate 150 may be cast into the deck or attached, as shown, by lag bolts 156.

Figure 28:
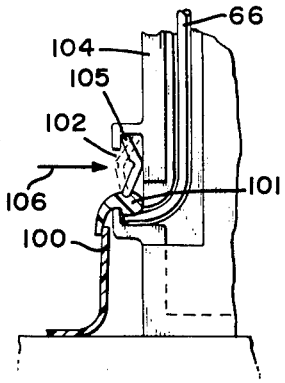
FIG. 28 is a fragmentary sectional view of the lower end of a modified wall panel module formed with an opening to receive the liner and shown with the liner securing mechanism.

By reference to FIG. 28, a modified liner 100 which covers only the floor area is described. This arrangement is used in conjuction with the panel juncture seals 66, to provide a water tight system. As seen in FIG. 28, the liner 100 is attached in a horizontally disposed continuous opening or recess formed in the wall panel 104. The bead 101 of liner 100 is placed in the opening 102 and is secured therein with a horizontally extending bow fastener 105 (dotted position) and locked in place by pressing in the direction of the arrow 106 to produce the locking effect of the bow fastener, in the manner of a toggle. The flexible bow fastener as shown in full line in FIG. 28 is in locked position.

Figure 29:
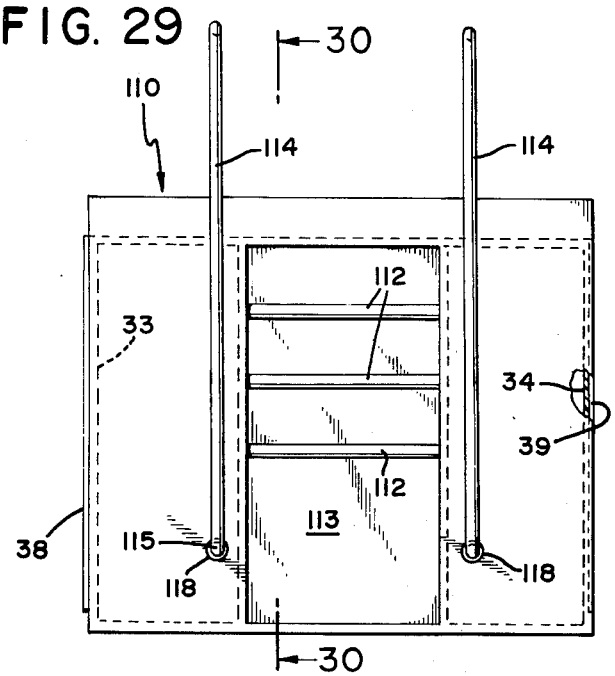
FIG. 29 is an elevational view of a wall panel module which is formed so as to include a ladder as an integral part of the module.
Figure 30:
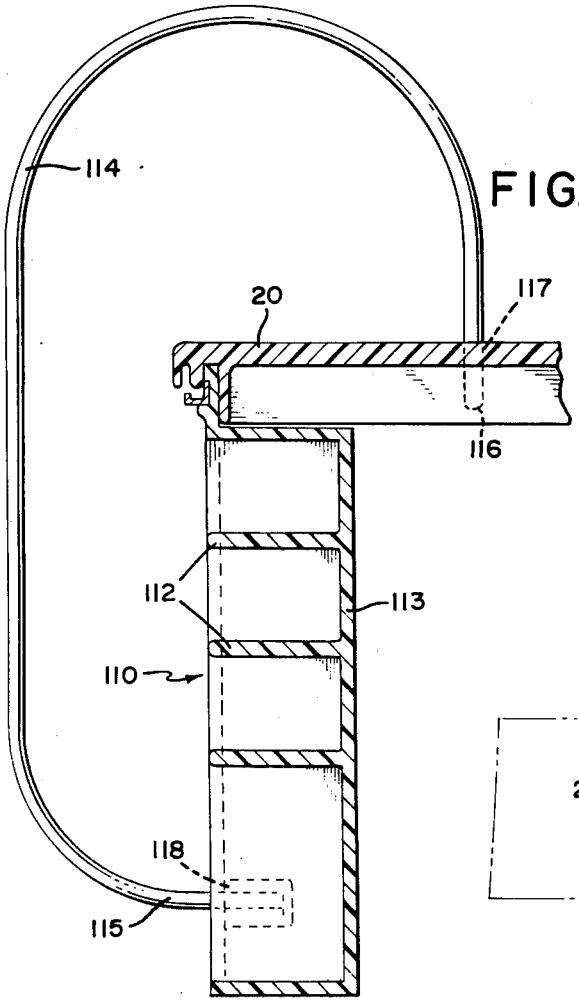
FIG. 30 is a sectional view taken along line 30—30 of FIG. 29 and illustrating alternate hand rail securing means.
Figure 30A:
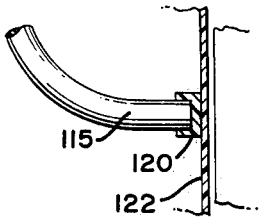
FIG. 30A is an enlarged sectional view showing details of the attachment of the ladder.

The process of molding individual components from a plastic material readily lends itself to the inclusion of various accessory features such as a wall panel module 110, FIG. 29, incorporating a ladder. The panel includes the various standard interlocking features as described in connection with the panel 16 above. Additionally, steps 112 are formed integral within an offset wall section 113, facing the interior of the pool. Two tubular hand-rails 114, which may be of conventional metal or suitable plastic material, may be supported at their lower ends 115 in holes 118 formed in the sidewall. The upper ends 116 may be secured in holes 117 formed in the deck 20. Alternatively, the lower end 115 of the handrail can be secured in a rubber bumper 120 which protects the liner 122 and, moreover, optionally may be fastened by adhesive to a liner 122 as shown in FIG. 30A. A modified handrail having substantially a circular contour 114*a* indicated in phantom in FIG. 30 may also be used and may be secured at its lower end by insertion in suitable holes formed in the steps 112.

In operation, the braces 50, the sidewall panel modules and the deck modules may be all prefabricated at the factory in accordance with suitable dimensions which have been predetermined.

The required number of panels for the pool selected, with nested braces and sealing strips 66 preassembled in the panels are shipped, optionally including deck modules, to a construction site. The pool walls are assembled by positioning two adjoining panels 16 upon a prepared pool floor, connecting the respective tongue and groove, and attaching the brace by snapping the clevis members 55 and 56 over the assembled flanges 33 and 34. The lower outer end of the brace is then suitably anchored. Further adjoining panels are similarly assembled until the wall encloses the pool. The deck modules, as described hereinabove, are mounted upon the upper end 32*a* of a panel and an adjoining deck module is similarly attached to its respective panel and interlocked by inserting the tongue 75 into the groove 76 of adjacent deck modules after which the brace clamp 70 is snapped over the adjoining end flanges 73 to secure the deck. Additional deck modules are similarly attached to complete the deck surrounding the pool. It will be understood that the curved deck modules 21 are formed with a suitable radius R-1 in order to properly mount upon the curved wall panels 17 which are formed with the same R-1 radius, (FIGS. 1, 2, 3 and 19).

The ladder panel 110 is adapted to be used in place of one of the straight panels 16 and can be arranged in any suitable position such as the end of the pool as seen in FIG. 1. Furthermore, the knock-out areas of the panel 16 may be used to insert fixtures 125 for water circulation and skimming operations.

The assembly of the oval pools, the kidney pools, and various free form pools proceeds in a manner similar to that described. It should be noted also that curved deck modules are formed with radii or contours which match corresponding radii or contours of wall modules to provide proper assembly. When a particular pool specification calls for a liner, it is attached to the sidewall panels as shown in FIGS. 2 and 27 or alternately, by using the wall panel structure 104, FIG. 28, with only the floor liner 100 as indicated by reference to the description provided in conjuction with FIG. 28.

Figure 31:
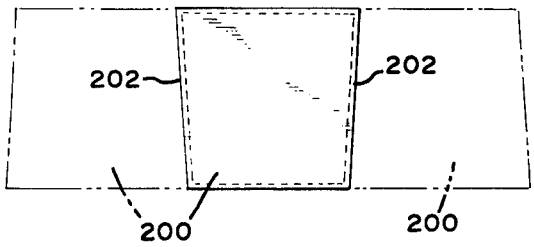
FIG. 31 is a diagrammatic elevational view of trapezoid shaped panels.

The wide variety of contours and shapes to which the present invention lends itself is further illustrated in FIG. 31 wherein a trapezoidal shaped wall panel 200 having slightly tapered end flanges 202 can be used to construct a vertical wall by inverting every other panel as shown in phantom. However, if a slightly angular or "dished" effect in the sidewall is desired, it can be accomplished by assembling all the panels 200 with the shorter ends at the bottom.

As noted hereinabove, the various structural modular components which form the pool are preferably formed of plastic. Any of the various commercially available synthetic resinous compositions, including thermosetting as well as thermoplastic resins may be employed and such compositions may include any of the well known fillers, modifiers, reinforcing agents, pigments, accelerators, stabilizers, such as a glass fiber, silica, talc, wood flour, titanium dioxide and the like may be incorporated. From a more practical standpoint, the modular components of the invention are preferably formed of foamed thermoplastic composition. Any of various known expandible compositions may be employed.

A foam density within the range of from about 20 to about 45 lbs. per cubic foot is preferably employed in preparing the foam modules of the invention. it is preferred that the foamed compositions have significant flexibility. This does not mean that it should not be substantially rigid, but rather that the cellular mass should have sufficient plasticity to avoid brittleness and, consequently, obviate cracking of the structure on repeated impact.

A wide variety of foamed resinous compositions known in the art, including homopolymers, copolymers, interpolymers and blends for which the ingredients are commercially available, may be used. Suitable examples of resinous compositions which are set forth hereinbelow for purposes of illustration only and not by way of limitation, include:

Polyethylene or polypropylene

In preparing cellular materials from these compositions a termally sensitive blowing agent which liberates gas at a specific temperature is generally employed. A correct choice of blowing agent will effect a product most suitable for the characteristics desired in the panels. Various densities of polyolefins are available for producing a wide range of foam properties. Various copolymers and blends of these chemical compositions as well as copolymers thereof with other polymerizable constituents may be used, depending on the physical properties desired.

Polyvinyl chloride

In the formation of this material a vinyl plastisol, i.e. a paste of finely divided polyvinyl chloride containing a plasticizer and a chemical blowing agent, may be employed. Upon the application of heat, and under pressure the polyvinyl chloride dissolves to form a gel and the chemical blowing agent produces the foaming gas. Upon cooling to room temperature, a solid material capable of retaining its shape results. Suitable foams may also be obtained from copolymers of vinyl chloride with vinylidene chloride and/or vinyl acetate and mixtures thereof with butadiene-acrylonitrile copolymers, for example.

Polystyrene, polystyrene, polymethylstyrene or copolymers thereof such as styrene-butadiene-acrylonitrile or styrene-acrylotrile copolymers may also be used as the foam compositions. These resins are readily expanded, for example, by impregnating with a small amount of low boiling hydrocarbon, e.g. petroleum ether, pentane, etc., and then heating above the softening point of the polymer, thereby gasifying the volatile impregnant to produce the foam. A procedure of this type is described in U.S. Pat. No 2,681,321. Alternatively, nitrogen-producing foaming agents may also be used. Another method comprises dissolving under pressure normally gaseous compounds such as methyl chloride, methyl ether, methylethyl ether, propylene, etc., into the aromatic polymer, below the critical temperature of the gaseous agent to form a gel releasing pressure on the compositions. A description of a like method, for example, appears in U.S. Pat. No 2,576,911.

Similarly, various other plastics, e.g. polyamides such as nylon 6, nylon 6,6; the polyesters such as polyethylene terephthalate; polycarbonates may also be employed with good results.

Various known methods such as injection or compression molding may be employed in fabricating the modular components in accordance with the invention.

The invention will be illustrated by the following examples which should not be construed as a limitation of the invention. Parts given are parts by weight unless expressly stated otherwise.

EXAMPLE 1

A mixture comprising, in parts by weight, 100 parts of polyethylene, 8 parts of a blowing agent azodicarbonomide, 1.3 parts calcium stearate, 1.2 parts calcium silicate, 0.4 parts of heat and light stabilizer and 1.6 parts of $TiO_2$ pigment are mixed and tumbled in a rotating drum for 20 minutes to assure thorough mixing and uniform coating of the blowing agents on the pellets.

The treated pellets are then employed in forming pool modules and braces of the configuration shown in FIGS. 7 and 5, respectively, using an extrusion molding machine operating at approximately 218° C. and a mold temperature of 20° C. The injection time is about 45 seconds and a cooling time of 3 minutes and 45 seconds. The surface of each of the pieces was smooth and all bosses and flange features are well formed.

EXAMPLES 2 AND 3

The procedure of Example 1 is repeated except that polypropylene (Example 2) and a 75/25 polyethylene-polypropylene copolymer (Example 3) are used instead of the polyethylene homopolymer. Comparably good results are obtained.

The invention, in addition to injection molding methods for fabricating the modules, contemplates also the use of sheet forming techniques in which a preformed sheet is molded or stamped under appropriate heat and pressure to induce the desired flow to form the desired configuration. In methods of this kind, the preformed sheet may contain a desired blowing agent which is activated at a desired elevated temperature or forming condition (although other activation means such as radiation may be used) at the time of shaping of the module.

Illustrative formable plastic sheet materials and forming methods for example may comprise the technique and composition of the kind known in the prior art i.e. the acrylonitrile—vinyl chloride reinforced resin laminate of U.S. Pat. No. 3,063,883 or the method and/or products foamed or unfoamed of U.S. Pat. Nos. 3,210,230, 3,317,645, 3,419,517 (nylon and other polyamides) 3,562,200 (Polyethylene terephthalate and related compositions) 3,670,064 and 3,684,645, for example.

EXAMPLE 4

The following ingredients are blended to a uniform mixture, fed into a conventional extruder, heated to 490° F to melt the resin and extruded in the form of a continuous sheet approximately 0.1 inch in thickness.

| Ingredients | Percent by wt. |
|---|---|
| Polyethylene resin pellets | 62 |
| Chopped glass fiber ¼"-2" long | 20 |
| Finely divided talc | 18 |

The mixture is formed into a continuous layer on a moving belt and consolidated by heat (449° ) and pressure (75 psi) from a coacting moving belt and drum to form a glass reinforced thermoplastic sheet composed of resin and filler. The sheet may optionally contain a minor amount of blowing agent to produce a less dense sheet.

The panel sheet is readily formable into the configuration illustrated in FIG. 7 and brace of FIG. 5 such as by reheating below the glass transition temperature and formed by a stamping operation. Thicker cross sections may be obtained by laminating two or more sheets of the preformed composite sheets during the stamping or shaping operation.

EXAMPLE 5

The procedure of Example 4 is essentially repeated except that polypropylene is utilized in lieu of polyethylene with comparably suitable results.

EXAMPLE 6

The procedure of Example 4 is essentially repeated except that polyethylene terephthalate is utilized in lieu of polypropylene.

EXAMPLE 7

The procedure of Example 4 is essentially repeated except that nylon-6 is utilized in lieu of polyethylene terephthalate.

Of particular significance in the invention is the ability to produce a molded plastic panel which provides the desired contours surface texture and color which because of uniform pigmentation throughout the plastic composition obviates the need for painting. Additionally, suitable inhibitors against attack of the plastic from pool chemicals, ultra violet radiation, etc., may be readily incorporated in the module forming plastic composition using compositions and procedures described in the literature and known to those skilled in the art.

The particular embodiments of the invention described above are merely illustrative and it is understood that various modifications can be made without departing from the scope of the invention as set forth in the following claims.

We claim:

1. A modular swimming pool wall panel being provided at its side extremities with flanges, each of said flanges having formed thereon upper and lower elements for locating continuous panels in a single predetermined vertical relationship, and by said upper and lower elements (with mating means for) interlocking said panel in situ with an adjacent panel to form the pool enclosure, said upper and lower elements providing a predetermined locking position thereon, respectively, for the upper and lower arms of a supporting brace.

2. The wall panel of claim 1 wherein said panel incorporates a sealing means in the mating means.

3. The panel of claim 1 wherein said panel comprises a substantially flexible structure substantially adaptable to be contoured when said wall panels are erected in situ to construct a pool having a free form shape.

4. A wall panel according to claim 1 provided with intermediate ribs in the wall area and wherein said ribs function to reinforce said panel and are arranged so as to provide a wall area between said ribs for nesting a pool wall supporting brace contiguous to said panel for shipping.

5. The wall panel of claim 1 comprising a horizontally extending opening in the lower part of the panel and facing the interior of the pool for receiving the bead of a pool floor liner.

6. The wall panel of claim 1 formed with at least one knock out element or opening formed in said panel for pool servicing facilities.

7. The swimming pool panel of claim 1 wherein said panel is provided with a horizontal pool deck supporting flange contiguous to the top edge of said wall panel.

8. The wall panel module of claim 1 further provided with a bottom flange and wherein said bottom flange incorporates a panel height adjusting element comprising an inclined surface fixed with respect to said panel and a wedge element movable with respect to said inclined surface.

9. A wall panel according to claim 1 fabricated of foamed composition.

10. The wall panel module of claim 1 shaped by stamping a preformed thermoplastic sheet.

11. The wall panel of claim 1 formed with a concave inner panel surface.

12. The wall panel of claim 1 formed with a convex inner panel surface.

13. The wall panel of claim 1 in which vertically spaced ladder steps are integrally formed in the wall facing the interior of the pool.

14. A swimming pool modular deck panel being provided at each of its side extremities with a flange which incorporates mating means for locating adjoining panels in a single predetermined horizontal relationship when interlocking said panel with an adjacent panel to form a pool deck, said panel having integrally formed thereon contiguous to, but spaced from its front, a depending extension which interlocks, when horizontally disposed in situ, with the upper extremity of a swimming pool vertical wall panel.

15. The deck panel of claim 14 including an integrally formed coping.

16. The deck panel of claim 14 including an integrally formed pool liner support element.

17. A swimming pool modular deck panel comprising a panel having an integrally formed front coping and spaced rearwardly thereof, but contiguous thereto, a depending extension, said extension being adapted to be secured (at one side) to a wall panel and extending substantially parallel thereto, said deck having an integrally formed flange at each of its sides, said flanges having formed thereon a locating element for adjoining deck panels in a predetermined horizontal relationship and to locate thereon (and attached at the other side to) a brace for supporting said deck, (said brace functioning) such that, in situ, said brace functions to interlock said (wall panel and said) deck panel to a wall panel.

18. The deck panel according to claim 17 wherein the panel is provided with a coping, a depending front support for securing said deck panel on a pool wall and a depending rear element to secure said deck panel on a supporting brace.

* * * * *

UNITED STATES PATENT OFFICE

CERTIFICATE OF CORRECTION

Patent No. 4,047,340 Dated September 13, 1977

Inventor(s) Donald H. Witte et al.

It is certified that error appears in the above-identified patent and that said Letters Patent are hereby corrected as shown below:

Column 14, line 46, "continuous" should read -- contiguous --.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*